US011071671B1

(12) United States Patent
Theriault et al.

(10) Patent No.: US 11,071,671 B1
(45) Date of Patent: Jul. 27, 2021

(54) AEROSOL CONTAINMENT ENCLOSURE

(71) Applicants: Richard Theriault, Lincoln, MA (US); Sean William Barrett, Sudbury, MA (US)

(72) Inventors: Richard Theriault, Lincoln, MA (US); Sean William Barrett, Sudbury, MA (US)

(73) Assignee: Aerosol Containment Container, LLC, Natick, MA (US)

( * ) Notice: Subject to any disclaimer, the term of this patent is extended or adjusted under 35 U.S.C. 154(b) by 0 days.

(21) Appl. No.: 17/098,586

(22) Filed: Nov. 16, 2020

Related U.S. Application Data

(60) Provisional application No. 63/198,559, filed on Oct. 27, 2020, provisional application No. 62/704,674, filed on May 21, 2020.

(51) Int. Cl.
*A61G 10/00* (2006.01)

(52) U.S. Cl.
CPC ..... *A61G 10/005* (2013.01)

(58) Field of Classification Search
CPC ..... A61G 10/005; A61G 11/00
USPC ..... 600/21–22
See application file for complete search history.

(56) References Cited

U.S. PATENT DOCUMENTS 2,915,074 A * 12/1959 Cameto ..... E04H 15/20 52/2.21
3,678,921 A * 7/1972 Brendgord ..... A61G 10/005 600/21
4,304,224 A * 12/1981 Fortney ..... B01L 1/04 128/201.29
4,335,712 A * 6/1982 Trexler ..... A61G 10/005 128/205.26
5,061,235 A * 10/1991 Hogan ..... A61B 16/00 600/21
5,864,767 A * 1/1999 Drumgoole ..... F42D 5/045 102/301

(Continued)

FOREIGN PATENT DOCUMENTS

WO WO-2005037163 A2 * 4/2005 ..... A61G 12/004

OTHER PUBLICATIONS

Kevin Ward et al. "AerosolIVE Tent: Compact Respiratory Isolation System", Apr. 2020, Michigan Center for Integrative Research. Attached. (Year: 2020).*

(Continued)

*Primary Examiner* — Navin Natnithithadha
*Assistant Examiner* — Sunita Reddy
(74) *Attorney, Agent, or Firm* — Kintner IP, LLC; Mary Frances Ludwig

(57) ABSTRACT

An aerosol containment enclosure is used to isolate an air mass immediately surrounding a patient known or suspected to have a disease which may be transmitted through the air. The enclosure cooperates with a patient support apparatus. In embodiments, a flexible rod supports a substantially aerosol impermeable covering and is connected to the patient support apparatus. The enclosure is collapsible to a predetermined collapsed shape and expandable to a predetermined erect shape. In embodiments, a portal in the covering provides access for care personnel or equipment. The aerosol containment enclosure is lightweight, compact, and partially or fully disposable. The enclosure may be rapidly erected around a patient in an ambulance or other treatment setting.

19 Claims, 14 Drawing Sheets

(56) References Cited

U.S. PATENT DOCUMENTS 6,001,057 A * 12/1999 Bongiovanni ..... A61G 1/04 5/629
6,321,764 B1 * 11/2001 Gauger ..... A61G 1/0212 135/128
7,481,234 B1 * 1/2009 Gustafson ..... E04H 15/425 135/156
2002/0045796 A1 * 4/2002 O'Connor ..... A61B 90/40 600/21
2002/0133100 A1 * 9/2002 Paschal, Jr. ..... A61G 10/005 601/16
2004/0111008 A1 * 6/2004 Perlatti ..... A61G 10/005 600/21
2004/0236174 A1 * 11/2004 Boone ..... A61G 11/00 600/21
2005/0004423 A1 * 1/2005 Shenosky ..... A61G 10/005 600/21
2006/0247487 A1 * 11/2006 Arts ..... A61G 11/009 600/21
2007/0056593 A1 * 3/2007 Kubicsko ..... B08B 15/026 128/846
2008/0120919 A1 * 5/2008 VanBasten ..... E04H 15/20 52/2.17
2009/0216069 A1 * 8/2009 Woodcock ..... A61B 90/40 600/21
2010/0044372 A1 * 2/2010 Kournikakis ..... B08B 15/026 220/9.2
2013/0204074 A1 * 8/2013 Belval ..... A61G 1/042 600/22
2014/0290162 A1 * 10/2014 Tanimoto ..... F24F 3/161 52/234
2014/0316455 A1 * 10/2014 Gnanashanmugam ..... A61B 17/135 606/202
2016/0074268 A1 * 3/2016 Breegi ..... A61G 11/009 600/21
2016/0115704 A1 * 4/2016 Burke ..... A61G 7/05 135/126
2016/0151218 A1 * 6/2016 Canty ..... A61G 7/047 600/21
2017/0231848 A1 * 8/2017 VanBasten ..... A61G 10/005 600/21
2018/0163978 A1 * 6/2018 Ziegler ..... F24F 3/161
2019/0282317 A1 * 9/2019 Fields ..... A61B 46/10
2019/0330874 A1 * 10/2019 Pescovitz ..... E04H 15/44
2019/0380901 A1 * 12/2019 Breegi ..... A61G 11/009

OTHER PUBLICATIONS

Hill, E., Crockett, C., Circh, R.W. et al. Introducing the "Corona Curtain": an innovative technique to prevent airborne COVID-19 exposure during emergent intubations. Patient Saf Surg 14, 22 (2020). https://doi.Org/10.1186/s 13037-020-00247-5. Attached. (Year: 2020).*

Bassin BS, Haas NL, Puls HA, Kota S, Kota SS, Ward KR. Rapid development of a portable negative pressure procedural tent. Int J Tuberc Lung Dis. Jul. 1, 2020;24(7):740-743. doi: 10.5588/ijtld.20.0317. PMID: 32718413. https://www.inspirerxllc.com/journal-2. Article Accepted Apr. 29, 2020.Attached. (Year: 2020).*

D250 bagging film Data Sheet, De-comp composites, INC., Mar. 15, 2006.Attached. (Year: 2020).*

Patient Transfers and Body Mechanics. Cross Country University's Caregiver Safety Series. pp. 1, 6-7, 2013. Attached, https://www.mylearningcommunity.com/online_learning/custom/cctc/cgs09trans/media/CGStrans.pdf (Year: 2013).*

Ferno EMS Patient Shield—YouTube, https://www.youtube.com/watch?v=-uhi5M3k0CE, Pub'd Apr. 22, 2020.

Stryker Corporation, Emergency Relief Patient Cover (product brochure), Pub. Date: Apr. 28, 2020.

* cited by examiner

AEROSOL CONTAINMENT ENCLOSURE

CROSS REFERENCE TO RELATED APPLICATION

This application claims the benefit of U.S. Provisional Application No. 62/704,674, filed May 21, 2020, and of U.S. Provisional Application No. 63/198,559, filed Oct. 27, 2020, both of which are hereby incorporated in their entirety.

TECHNICAL FIELD

The present invention pertains generally to protective medical equipment, and more particularly to an aerosol containment enclosure.

BACKGROUND OF THE INVENTION

SARS-CoV-2 (the virus which causes coronavirus, also referred to as COVID-19) and other pathogens may be spread via airborne transmission. There is a need to protect emergency first responders and healthcare workers from both known and unknown threats. It is desirable that enhanced protection for care personnel be deployable in facilities such as emergency rooms, nursing homes, assisted living facilities, or ambulances. It is further desirable that such protection be rapidly deployable, low cost, and disposable or easily cleaned and stored.

BRIEF SUMMARY OF THE EMBODIMENTS

An aerosol containment enclosure is used to isolate an air mass immediately surrounding a patient known or suspected to have a disease which may be transmitted through the air. The enclosure cooperates with a patient support apparatus, such as a stretcher or bed. In an exemplary configuration, the enclosure includes a flexible rod supporting a transparent, substantially aerosol impermeable covering. The enclosure is collapsible to a predetermined collapsed shape and expandable to a predetermined erect shape. In the erect shape the enclosure is semi-rigid and has a foot end and two opposing sides which have a flexible portions to draped over the patient support apparatus.

In embodiments, the flexible rod has a connector structured for attachment to the patient support apparatus. The connector may cooperate with a coupler connected to the patient support apparatus. The connector may be a free tip sized and dimensioned for insertion into a recess of the coupler. The free tip may be shaped substantially complementary to the recess. The recess may have a bore and two wings extending from the bore. The recess may have a bore that is tapered in width from a wider bore top to a more narrow bore bottom.

In embodiments, the enclosure includes a portal in the covering that provides access to an interior of the enclosure and that restricts transfer of aerosols out of the interior. The portal may include an aperture and a flap completely covering the aperture. The flap may be sealed around a portion of the aperture. The flap may have an unsealed portion that overlaps the covering. The portal provides access to the interior of the enclosure through the unsealed portion of the flap.

In embodiments, the enclosure is self-erecting to the predetermined erect shape.

These and other aspects of the embodiments will be better appreciated and understood when considered in conjunction with the following description and the accompanying drawings. The following description, while indicating various embodiments and details thereof, is given by way of illustration and not of limitation. Many substitutions, modifications, additions, or rearrangements may be made within the scope of the embodiments, and the embodiments may include all such substitutions, modifications, additions, or rearrangements.

Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments. Also, common but well-understood elements that are useful or necessary in a commercially feasible embodiment are often not depicted in order to facilitate a less obstructed view of these various embodiments.

DETAILED DESCRIPTION OF THE INVENTION

Figure 1:
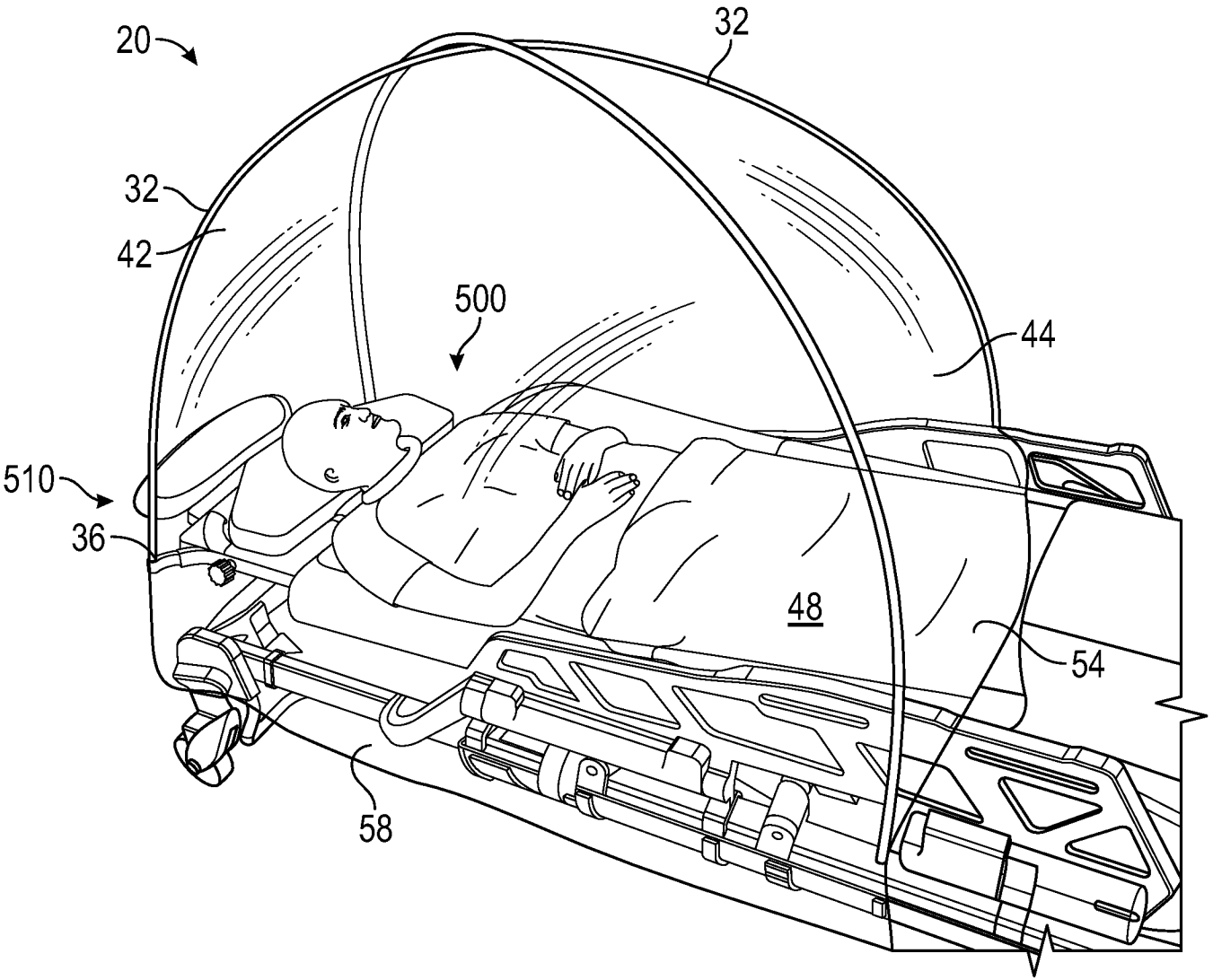
FIG. 1 is a perspective view of an embodiment of an aerosol containment enclosure.
Figure 2:
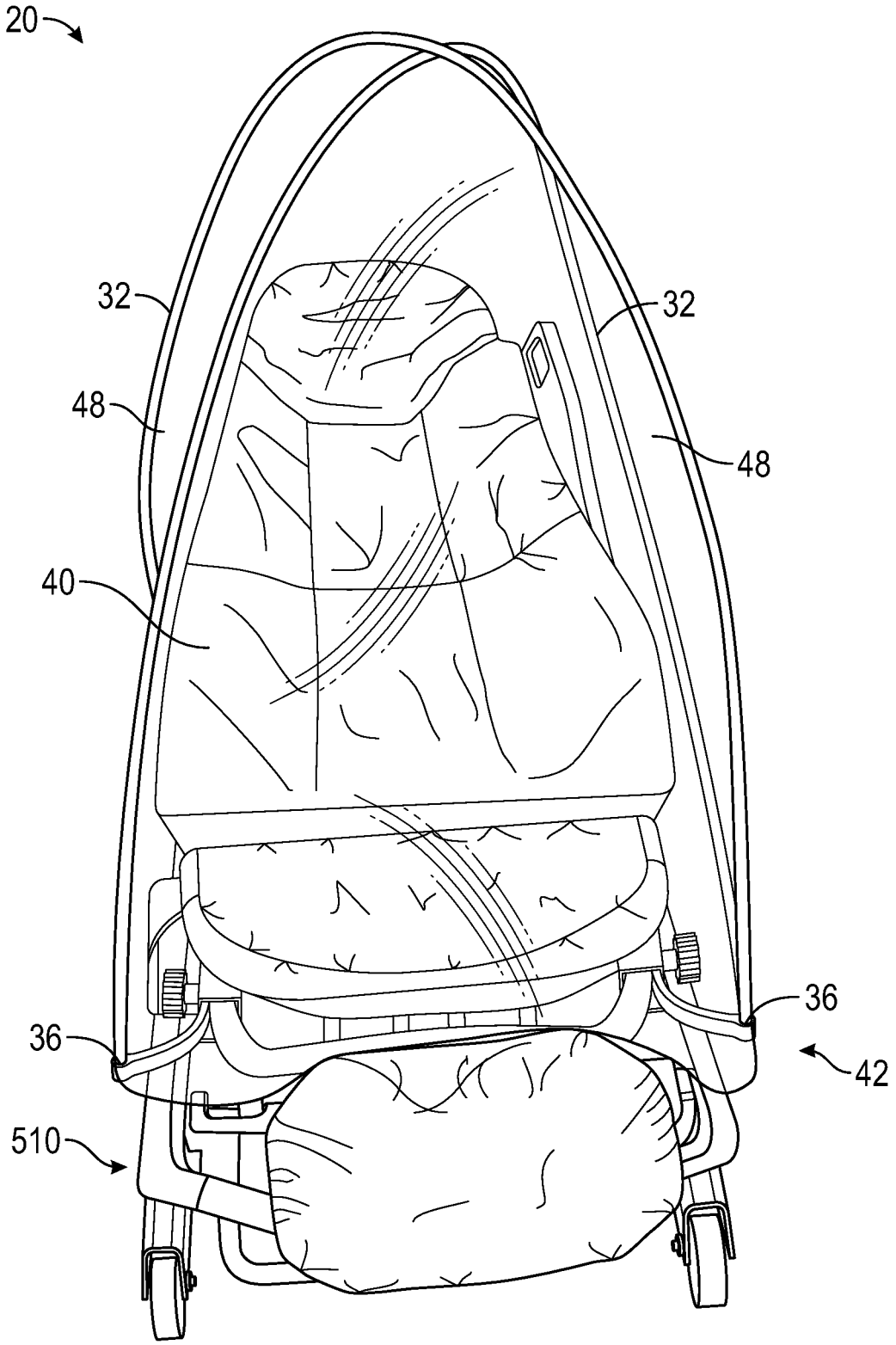
FIG. 2 is a top view of the FIG. 1 embodiment.
Figure 3:
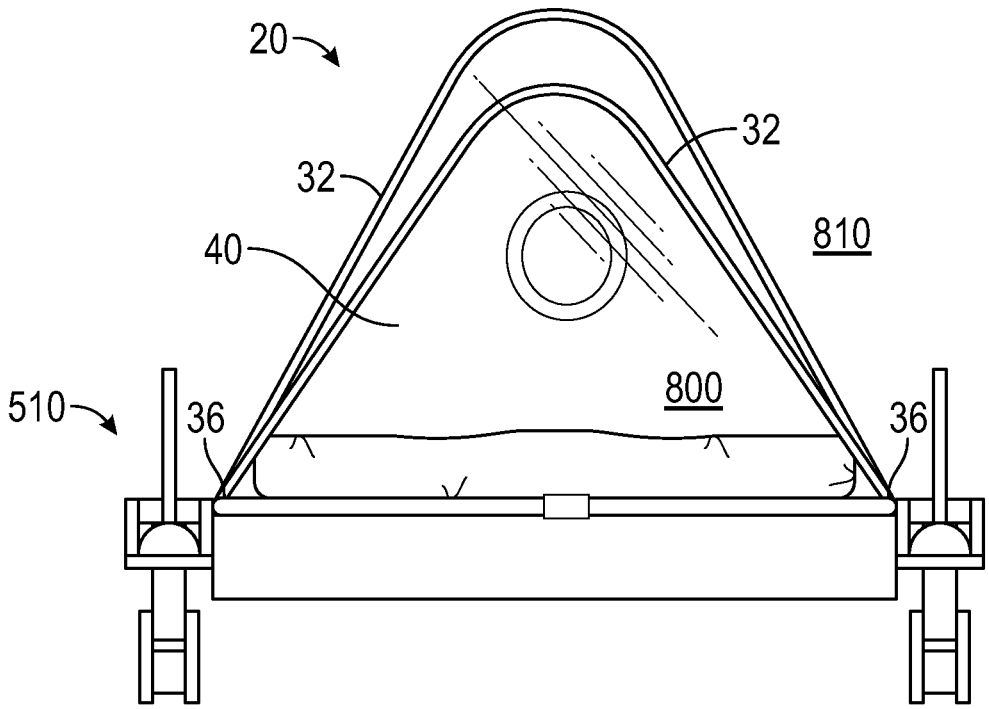
FIG. 3 is a front view of the FIG. 1 embodiment.

FIGS. 1-3 show perspective, top, and front views, respectively, of an embodiment of an aerosol containment enclosure generally designated as 20. Enclosure 20 is shown in use with a patient 500 supported on a cooperating patient support apparatus 510, such as a stretcher, gurney, or bed. Enclosure 20 includes one or more flexible rods 32 which support a covering 40 above the patient. Covering 40 is substantially aerosol impermeable; in other words, covering 40 substantially prevents transfer of aerosols between an air mass 800 inside the enclosure and an adjacent air mass 810 surrounding the exterior of the enclosure. In this manner the enclosure significantly reduces the risk to medical personnel and other attendants of exposure to potentially hazardous aerosols expelled by the patient.

As used herein, the term "aerosol" refers to any liquid or solid particles suspended in air, regardless of droplet size, composition, or potentially hazardous properties. Aerosols may be created by a patient during common human activities such as breathing, talking, coughing, or sneezing. Aerosols may also be created during certain medical procedures such as intubation or surgery.

Enclosure 20 is semi-rigid when in an erect position, as shown for example in FIGS. 1-3. As used herein, the term "semi-rigid" means being neither entirely flexible nor entirely rigid; a semi-rigid element may include portions that are flexible or rigid. In the erect position enclosure 20 has a rigid portion in the region of flexible rod 32. The rigid portion includes a head end 42 configured for placement behind the head of the patient; a foot end 44 opposite the head end; and two opposing sides 48 which extend from head end 42 toward foot end 44 and at least partially cover the patient's torso.

In the erect shape, foot end 44 and two opposing sides 48 each have a flexible portion which is sized to be draped over patient 500 or patient support apparatus 510. In embodiments, flexible portion 54 of foot end 44 extends beyond flexible rod 32 in a direction generally away from head end 42. Flexible portion 54 may cover some or part of the patient's torso or legs, and may be arranged under a blanket or sheet to further reduce air transfer.

Flexible portion 58 of each of the two opposing sides 48 extends below flexible rod 32, and may extend over a support surface or railing of the patient support apparatus. Flexible portions 58 may be folded with a sheet, such as a bed linen, blanket, paper or plastic sheeting; or other covering for the patient support apparatus, which may further reduce transfer of air. Folding flexible portions 58 with the sheet may be useful to transfer the patient with the enclosure between a first and second patient support apparatus, as described in more detail below.

The bottom of enclosure 20 is open when the enclosure is expanded and not attached to a patient support apparatus. The open bottom allows enclosure 20 to be placed over the patient and connected to the patient support apparatus. The open bottom is bounded by flexible portions 54 and 58 which reduce air flow out of the enclosure. A flexible portion may also be present at head end 42.

A particular benefit of the semi-rigid nature of enclosure 20 is that it may be expandable to a predetermined erect shape and collapsible to a predetermined collapsed shape. A predetermined erect shape is any shape of an enclosure that is fairly consistent when the enclosure is expanded to substantially its maximum size. By assuming a fairly consistent shape when expanded, the enclosure can be dimensioned and configured to fit within a particular space or cooperate with a particular structure. A predetermined collapsed shape is any shape of an enclosure that is fairly consistent when the enclosure is collapsed to substantially its minimum volume. By assuming a fairly consistent shape when collapsed, the enclosure can be more easily stored and transported.

In some embodiments, enclosure 20 is self-erecting to the predetermined erect shape. A self-erecting enclosure 20 may be retained in the collapsed shape, for example with a tie or clasp, or in a storage case or other packaging. When the enclosure is released from the collapsed shape, the enclosure self-erects to the erect shape. In other words, the self-erecting enclosure assumes the semi-rigid, erect shape substantially without manipulation of the flexible rods. The self-erecting feature may enable the enclosure to maintain a rigid portion when the enclosure is not in cooperation with a patient support apparatus, such as when a patient is being transferred between a first and a second patient support apparatus while the patient is under the enclosure.

Figure 4:
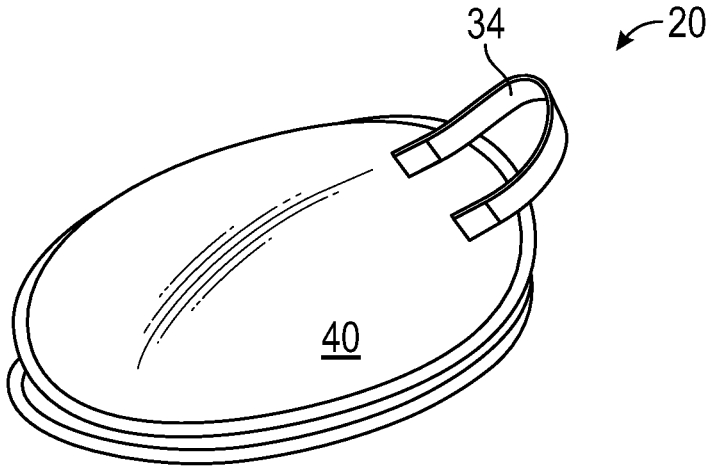
FIG. 4 is a perspective view of an embodiment of the enclosure in a collapsed position.

FIG. 4 is a perspective view of an embodiment of the enclosure in a collapsed position wherein enclosure 20 is in a predetermined collapsed shape. In the collapsed shape, enclosure 20 is substantially flat and significantly smaller than when in the erect shape. Enclosure 20 may optionally include one or more carrying handles 34.

By way of example, the shown embodiment may have a folded diameter of about 10 inches and a thickness of about 0.5 to 1 inch. The same embodiment in the erect shape may have a rigid portion with dimensions (W×L×H) of about 20×20×24 inches. Other exemplary sizes (W×L) include: 16×36 inches, 20×40 inches, 22×44 inches, 24×48 inches, or 26×48 inches. Heights may be, for example, 18, 20, or 24 inches.

Covering 40 is a substantially transparent sheet of material. A high degree of transparency improves visibility both for the caregiver and the patient, which may facilitate patient monitoring, simplify performing medical procedures with the enclosure in place, and reduce patient anxiety. Materials suitable for covering 40 include polyvinyl chloride, thermoplastic polyurethane, or linear low-density polyethylene. The semi-rigid nature of the enclosure may also improve transparency, since within the rigid portion the covering will have substantially no gathered or folded regions. In embodiments, the covering is formed of a material having a thickness of between about 0.002 inches and about 0.008 inches.

Flexible rod 32 may be a flexible plastic or metal rod, and may be segmented. Multiple flexible rods 32 may be connected to one another by joints or clips. Flexible rod 32 may for example have a diameter of 1/16 inch, 1/8 inch, or 1/4 inch. The flexible rod may include the following materials: polycarbonate, acrylic, polyvinylchloride (PVC), polyethylene terephthalate glycol-modified (PETG), polytetrafluoroethylene (PTFE), polypropylene, acrylonitrile butadiene styrene (ABS), nylon, acetal, ultra-moisture-resistant polychlorotrifluoroethylene (PCTFE), hard fiber, fiberglass, fiberglass-epoxy laminate, or stainless steel.

Flexible rod 32 has a connector 36 which is located near the head end when the enclosure is in the erect position. Connector 36 is structured for attachment to patient support apparatus 510. Multiple connectors 36 are present in some embodiments, and some connectors may not be near the head end of the enclosure. In some embodiments, connector 36 may attach directly to the patient support apparatus. Embodiments of connector 36 suitable for direct attachment to the patient support apparatus include a strap, a hook and loop fastener, and a fabric tie.

Figure 5:
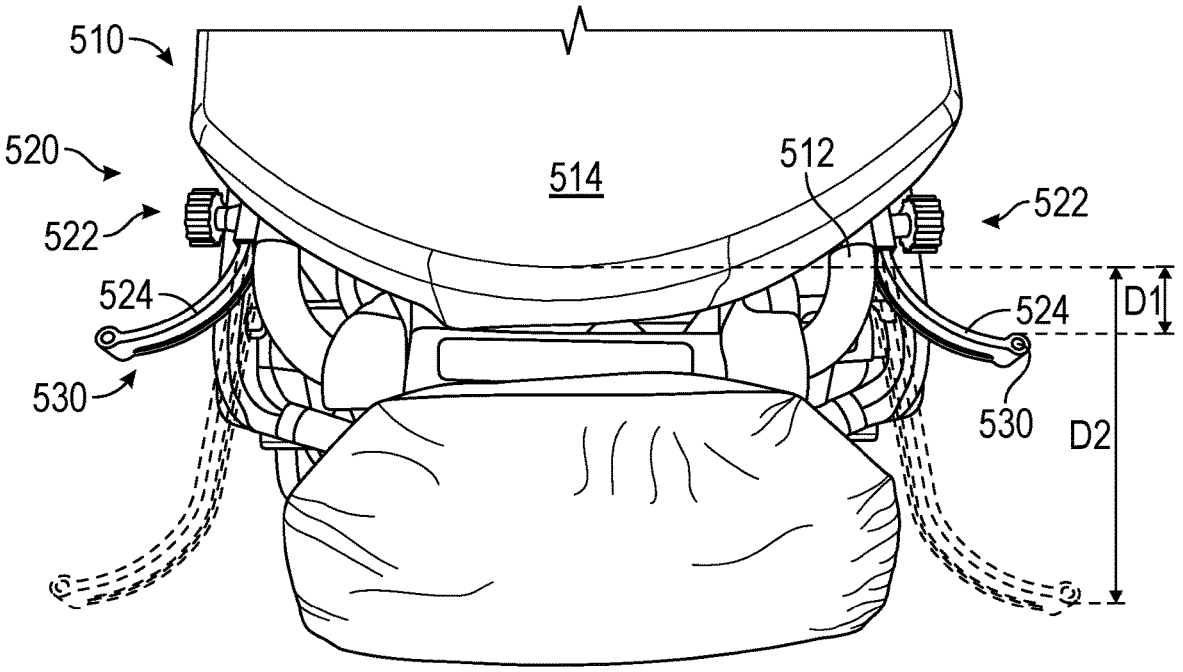
FIG. 5 is an enlarged top view of an embodiment of a coupler.
Figure 6:
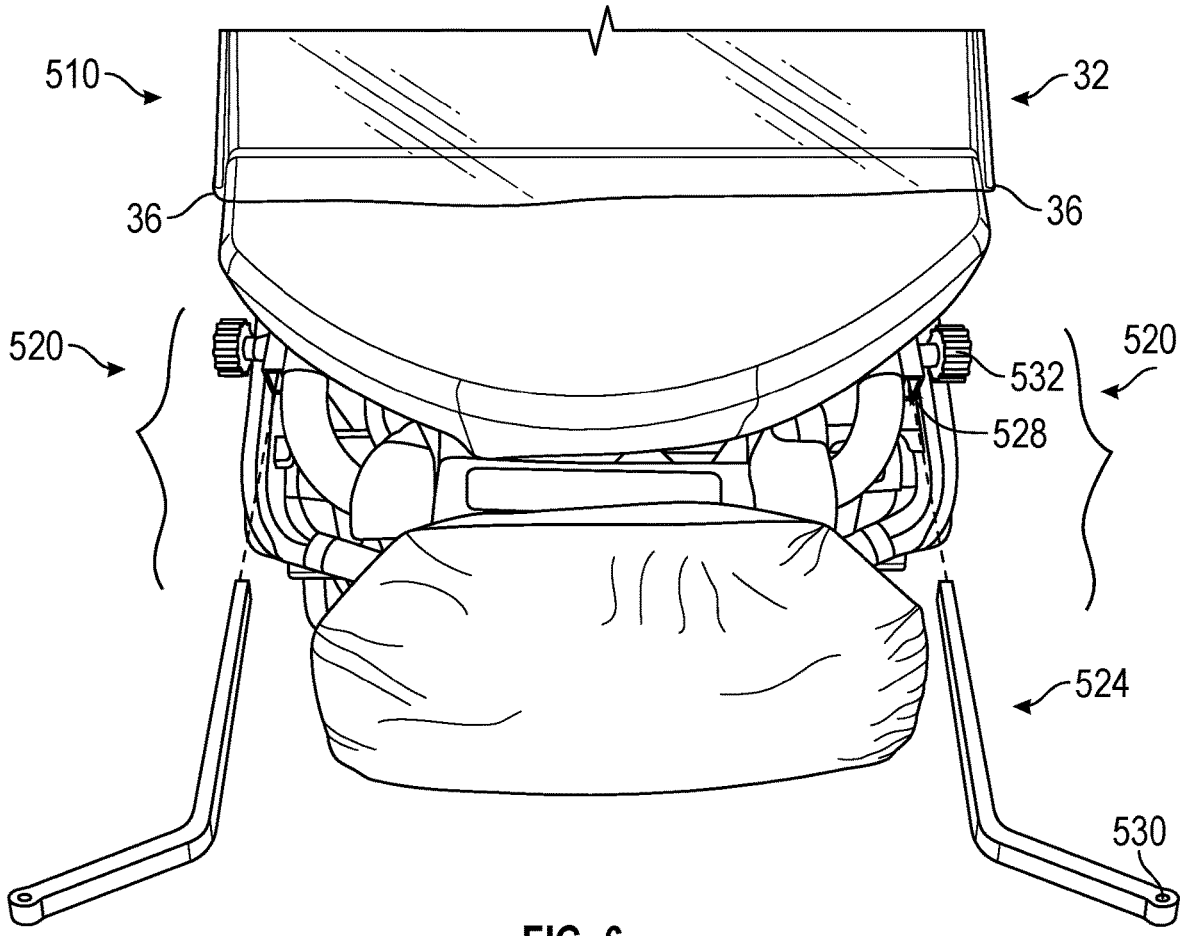
FIG. 6 is a partial enlarged top view of an embodiment of the enclosure cooperating with the coupler.

Embodiments of connector 36 cooperate with a coupler 520 connected to the patient support apparatus. FIGS. 5 & 6 show an embodiment of a coupler including a clamp 522 and an adjustable arm 524. Clamp 522 is structured to attach to the frame 512 of the patient support apparatus. As illustrated, clamp 522 may surround a portion of frame 512, such as a railing. Clamp 522 may be held in position with a retainer such as a screw. Clamp 522 may include a slot 528 shaped and dimensioned to receive arm 524.

Arm 524 has a recess 530 oriented toward the head end of the enclosure. In the shown embodiment, connector 36 is a free tip of flexible rod 32. Connector 36 is sized and dimensioned for insertion into the recess 530 of the arm of the coupler (see also FIG. 2). In this manner the enclosure may be readily attached to the patient support apparatus and may also be readily removed without damaging the enclosure or coupler.

The position of arm 524 within clamp 522 may be adjusted, such as by releasing the retaining knob 532; sliding arm 524 laterally within slot 528; and tightening knob 532. An alternate position of arms 524 is shown in broken lines of FIG. 5. By adjusting the arm positions, recess 530 may be positioned at varying distances (D1, D2) relative to the top 514 of patient support apparatus 510. This feature allows adjustment of the clearance within enclosure 20 between the top of the patient's head and top 514 of the support apparatus. Adjusting the headspace may be desired to accommodate equipment, provide access for medical personnel, or increase patient comfort. By positioning clamp 522 in different locations along the side of frame 512 an even greater range of adjustment may be obtained.

Figure 7:
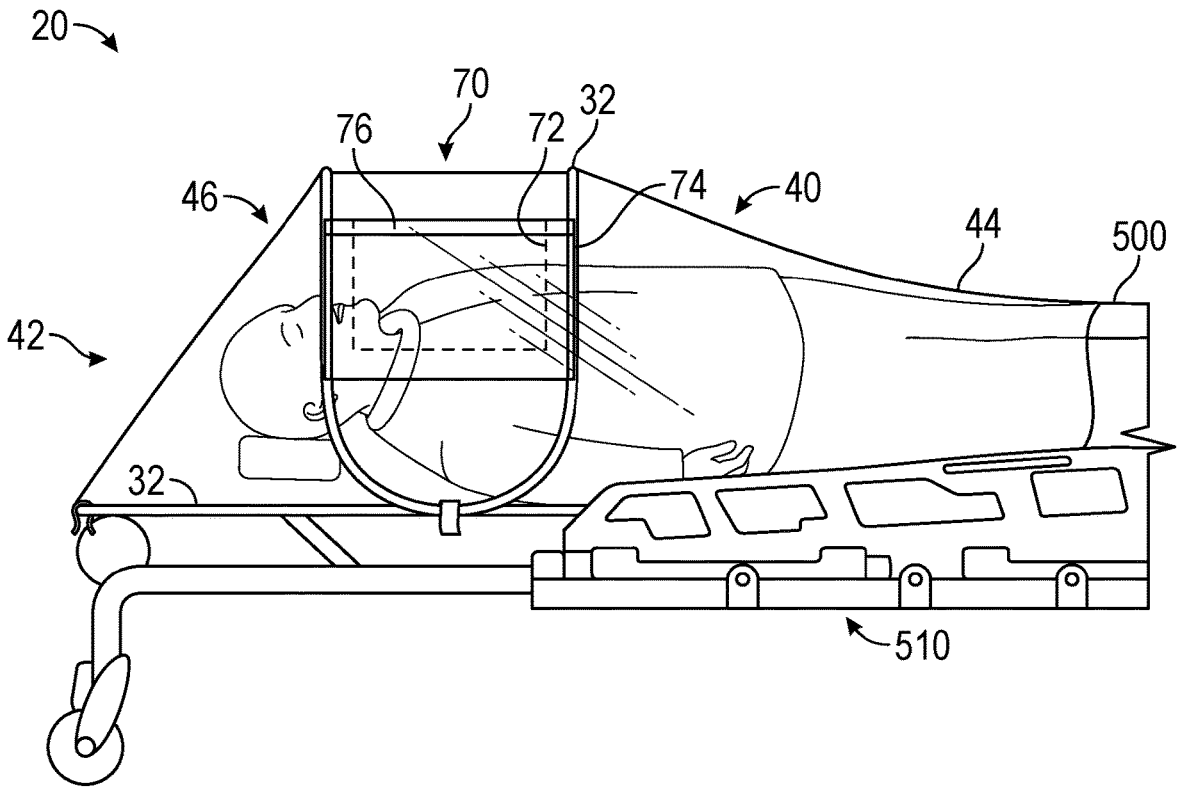
FIG. 7 is a side view of another embodiment of the enclosure.

FIG. 7 is a side view of another embodiment of enclosure 20, including a portal 70 which provides access to the interior of the enclosure while restricting the transfer of aerosols out of the enclosure. Portal 70 includes an aperture 72, shown in dashed lines. A flap 74 is sealed to covering 40 around a portion of aperture 72, such as along a top edge 76 of the aperture. Flap 74 is sized to completely cover aperture 72 and to form an aerosol barrier around unsealed edges of the aperture, such as by overlapping covering 40.

In an example use case, portal 70 may allow a care provider to reach their hands into the enclosure by lifting flap 74. Flap 74 would extend over the top of the care provider's arms inhibiting the flow of air and aerosols out of the enclosure in the direction of the provider's face. In some embodiments, portal 72 is sized to provide access to the interior of the enclosure along the entire length of the rigid portion from heat end 42 to foot end 44.

Figure 8:
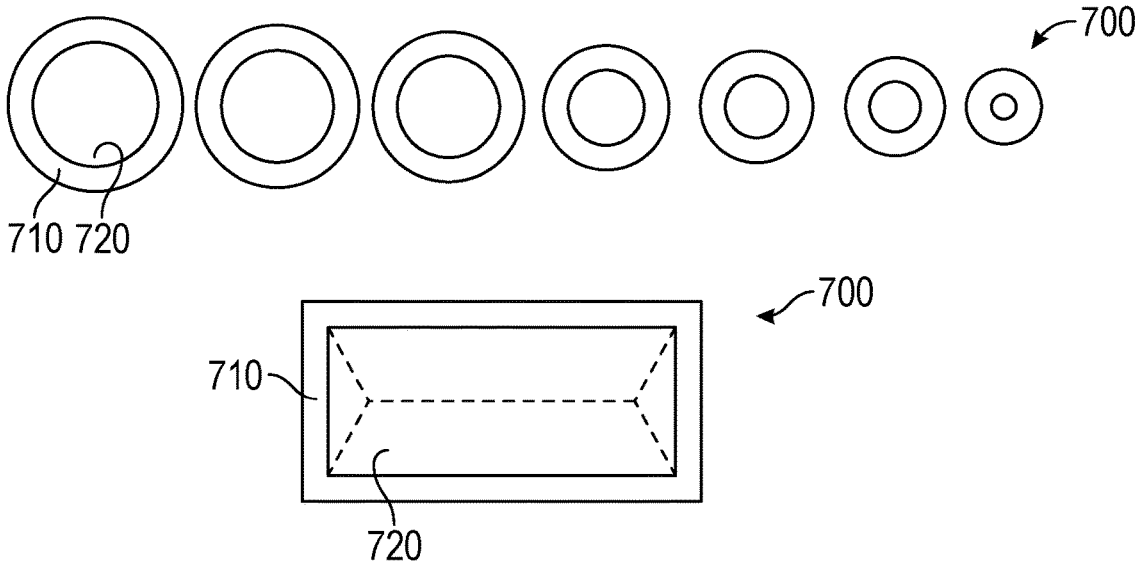
FIG. 8 illustrates several embodiments of a pad.
Figure 9:
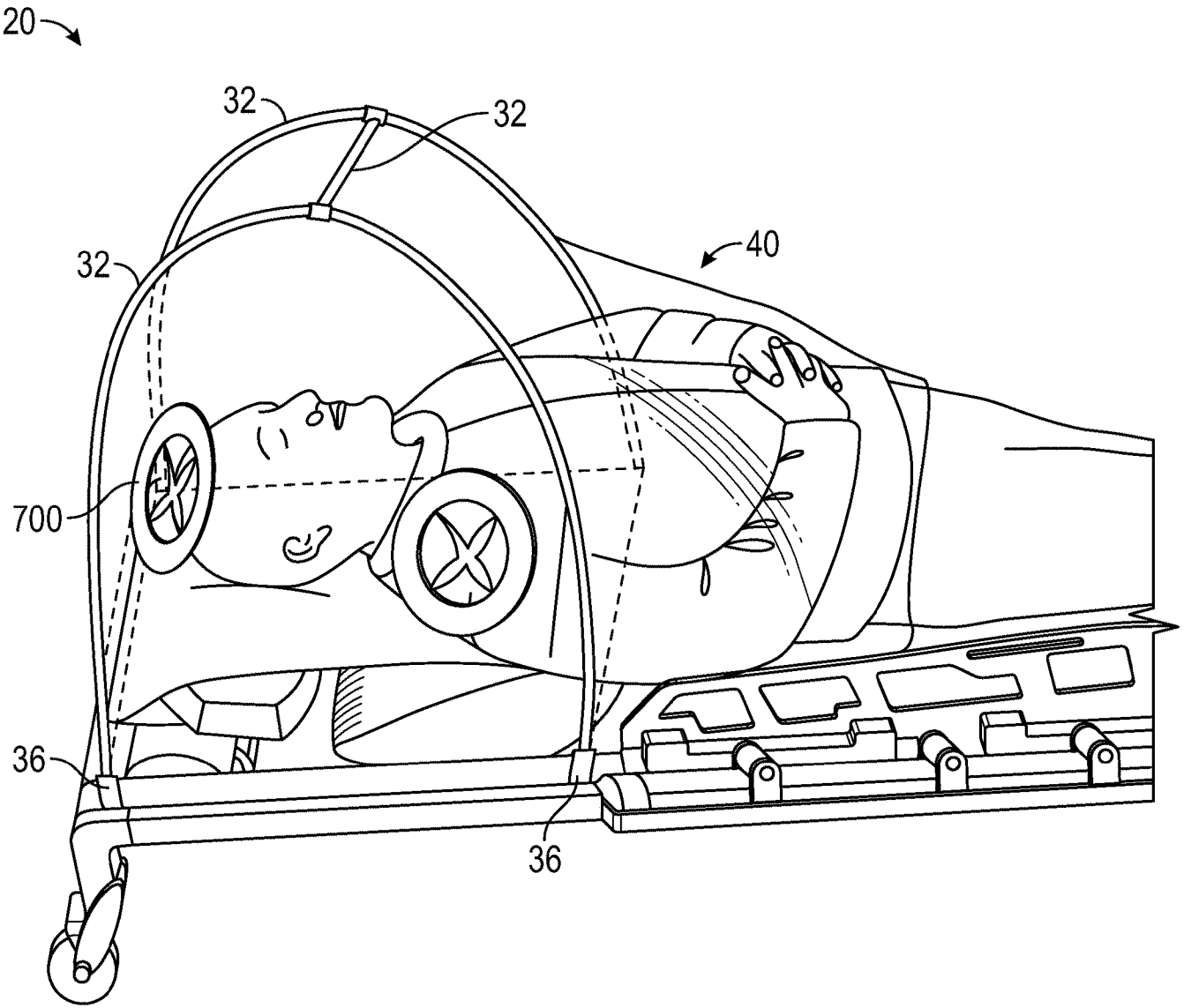
FIG. 9 is a perspective view of another embodiment of the enclosure.

FIGS. 8 and 9 illustrate several embodiments of a pad 700 which may provide access to the interior of enclosure 20. In embodiments, pad 700 has a sealing surface 710. Sealing surface 710 surrounds a frangible layer 720. When pad 700 is connected to covering 40 frangible layer 720 may be broken to provide access as may be desired for personnel or equipment.

Pad 700 may be provided with the enclosure or may be obtained separately and may cooperate with the enclosure. In embodiments, pad 700 may be an adhesive flange. One or more pads 700 may be applied to the covering in various locations. Pad 700 may have markings which indicate a location to be cut. Pad 700 may be perforated or otherwise readily broken to provide first responders with easy access. Pad 700 may be brightly colored for increased visibility. Pad 700 may be self-sealing, may be fitted with a glove, or may provide another configuration which allows sterile access. Exemplary dimensions of pad 700 are between 3-7 inches outer diameter (sealing surface 710) and between 1-5 inches inner diameter (frangible layer 720).

Various configurations of enclosure 20 may be desired in different care settings. For instance, in an ambulance where space is restricted and transit time is relatively brief, an enclosure with a compact folded size which opens to provide a low dome may be desired. If the enclosure is used during a surgical procedure, a more spacious dome may be desired and a slightly larger folded size may be acceptable. Similarly, different configurations of flexible rod 32 may provide a larger accessible rigid area or a rigid area located within different regions of the covering (e.g. behind the head, above the head, along the side). Having access in a specific region of the covering may be desired for performing certain procedures or providing access for specific types of equipment.

Figure 10:
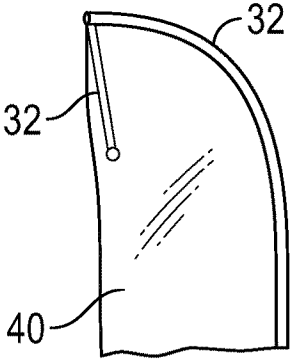
FIG. 10 is a top view of another embodiment of the enclosure in a collapsed position.

FIGS. 9 & 10 show another embodiment of the enclosure in erect and collapsed positions, respectively. This embodiment of enclosure 20 has three flexible rods 32. Four connectors 36 are included, two of which are visible and two of which are hidden from view. Two connectors 36 are proximate head end 42 and two connectors are near foot end 44. Connectors 36 may cooperate with couplers to connect to patient support apparatus 510, or may attach directly to the patient support apparatus.

Figure 11:
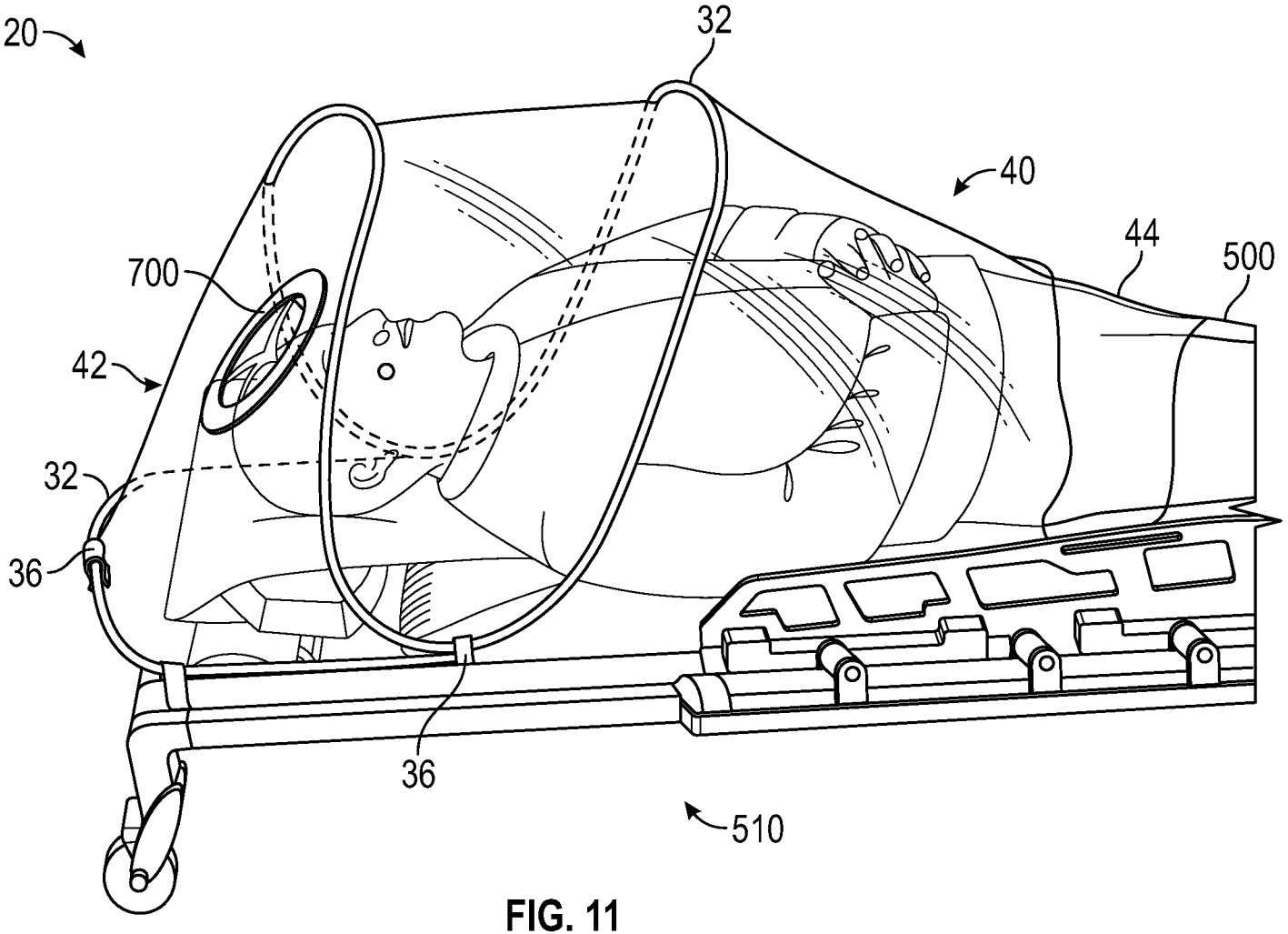
FIG. 11 is a perspective view of another embodiment of the enclosure.

FIG. 11 is a perspective view of another embodiment of the enclosure in the erect position. This embodiment of enclosure 20 has two flexible rods 32. Three connectors 36 are included, one proximate head end 42 and two near the patient's shoulders (one is hidden from view). Connectors 36 attach directly to the patient support apparatus. In the collapsed position, this embodiment appears substantially as shown in FIG. 4.

Figure 12:
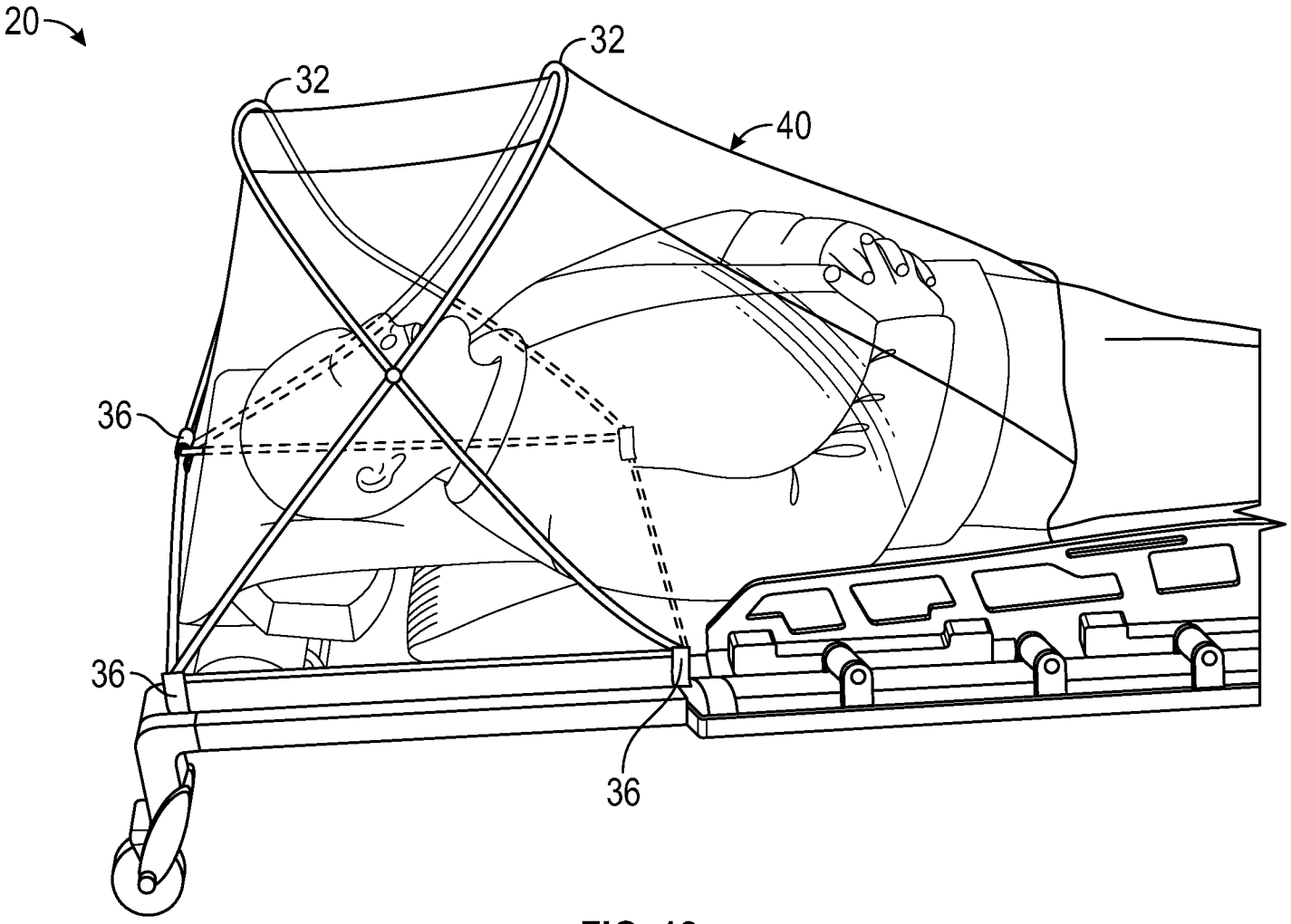
FIG. 12 is a perspective view of another embodiment of the enclosure.

FIG. 12 illustrates another embodiment of enclosure 20 in the erect position. The shown embodiment has two flexible rods 32 and four connectors 36 (one hidden from view). Connectors 36 may cooperate with couplers to connect to patient support apparatus 510, or may attach directly to the patient support apparatus. This embodiment may be self-erecting, or may require manipulation of the flexible rods to transition between the collapsed and erect positions.

Figure 13A:
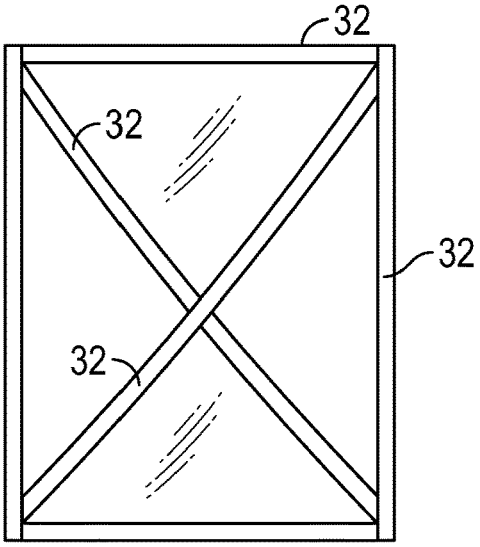
FIG. 13A is a top view of another embodiment of the enclosure in a partially collapsed position.
Figure 13B:
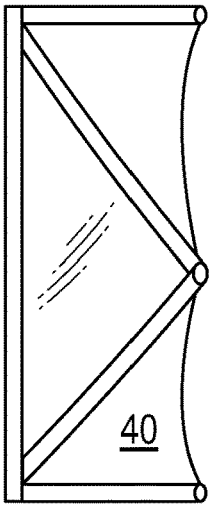
FIG. 13B is a top view of the embodiment in a fully collapsed position.

FIGS. 13A & 13B show another embodiment of enclosure 20 in partially and fully collapsed positions, respectively.

Figure 14:
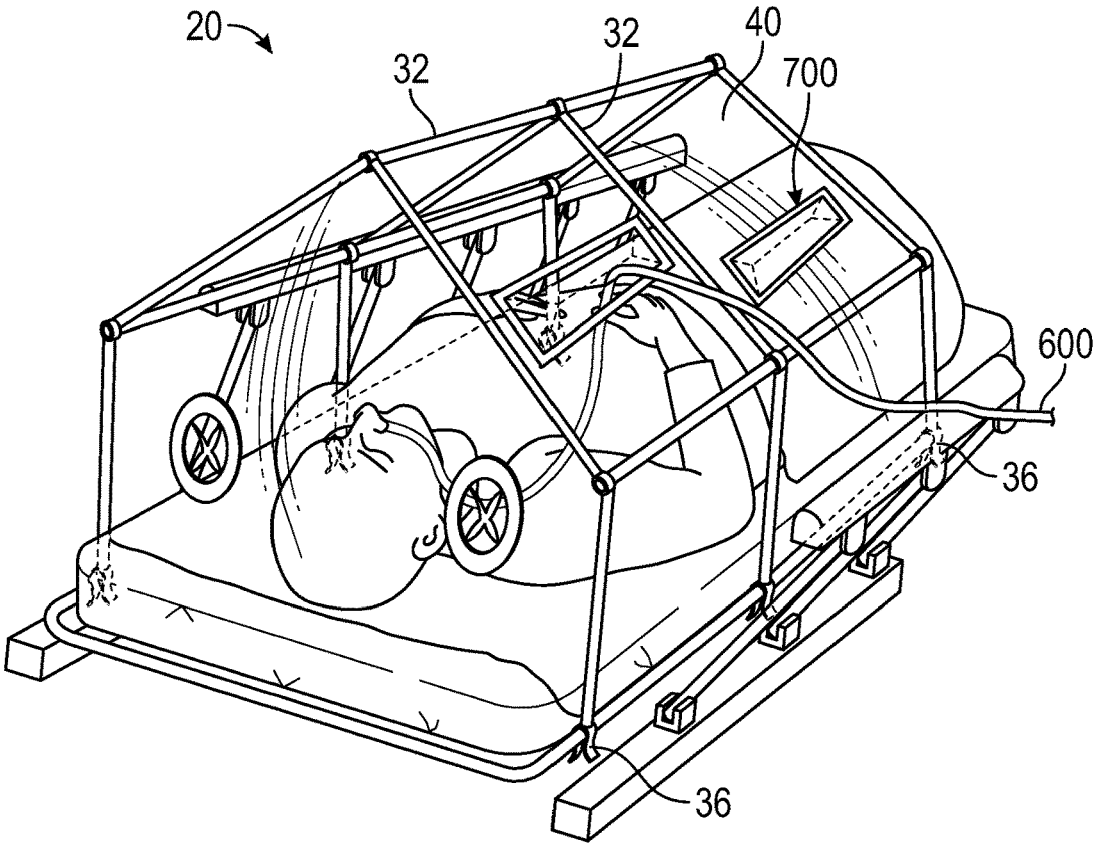
FIG. 14 is a perspective view of another embodiment of the enclosure.

FIG. 14 shows another embodiment of enclosure 20 in the erect position. This embodiment includes multiple flexible rods 32, and is configured to connect directly to the patient support apparatus, such as with the straps shown (six of connector 36 are present in this embodiment). Medical equipment 600 is partially shown having a tube or cable passing through a pad 700, such as to provide the patient with oxygen or intravenous fluids. In another embodiment, medical equipment 600 may be an air filtration system, such as a high-efficiency particulate air (HEPA) filter. Such equipment may be used to transfer filtered air into the enclosure or to filter air leaving the interior of the enclosure.

Figure 15A:
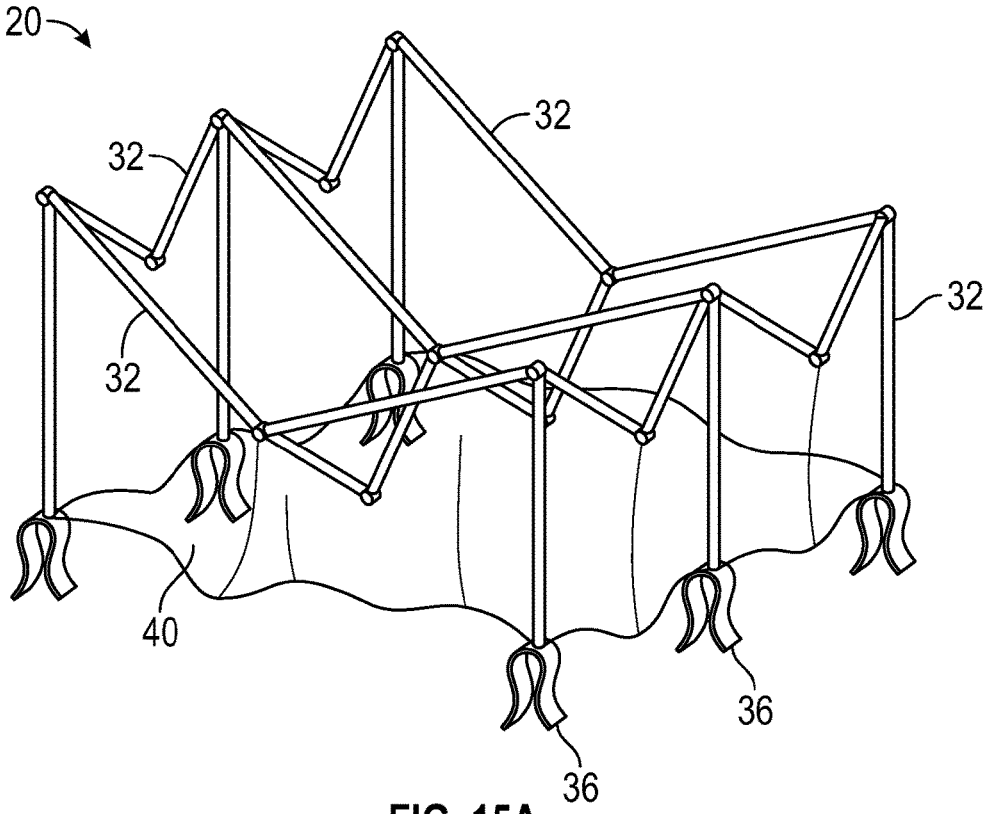
FIG. 15A is a perspective view of another embodiment of the enclosure in a partially expanded position.
Figure 15B:
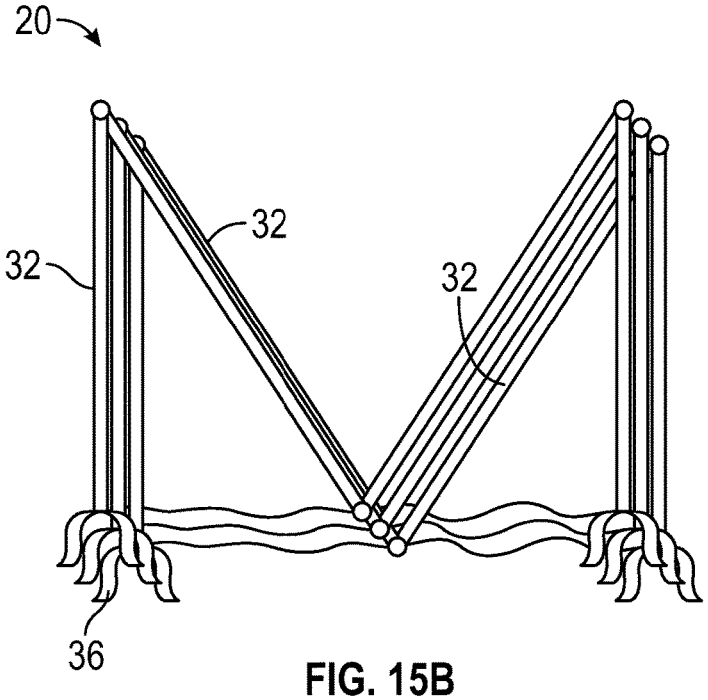
FIG. 15B is a view of the embodiment in a partially collapsed position.
Figure 15C:
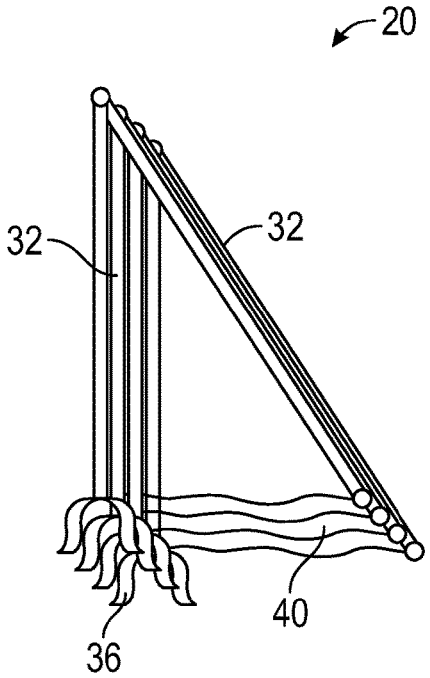
FIG. 15C is a view of the embodiment in a fully collapsed position.

FIGS. 15A & 15B show the embodiment in different partially collapsed positions; FIG. 15C shows the completely collapsed position. Connectors 36 for direct connection to the patient support apparatus are best seen in FIG. 15A. In another embodiment, connectors 36 may cooperate with couplers.

Figure 16:
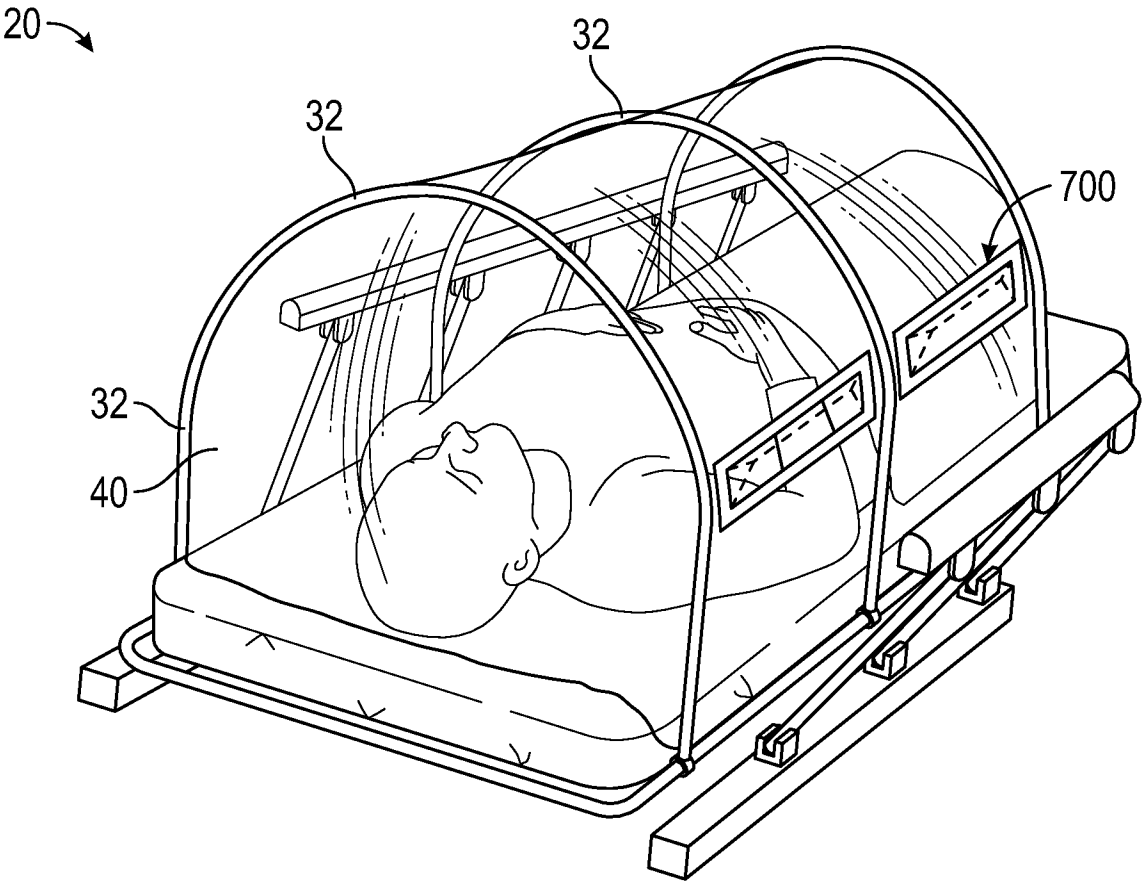
FIG. 16 is a perspective view of another embodiment of the enclosure.
Figure 17A:
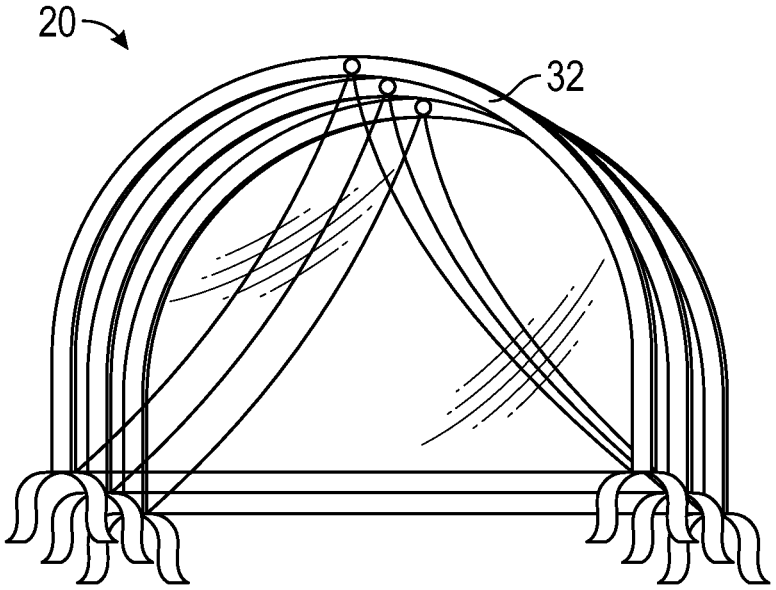
FIG. 17A is a perspective view of another embodiment of the enclosure in a partially collapsed position.
Figure 17B:
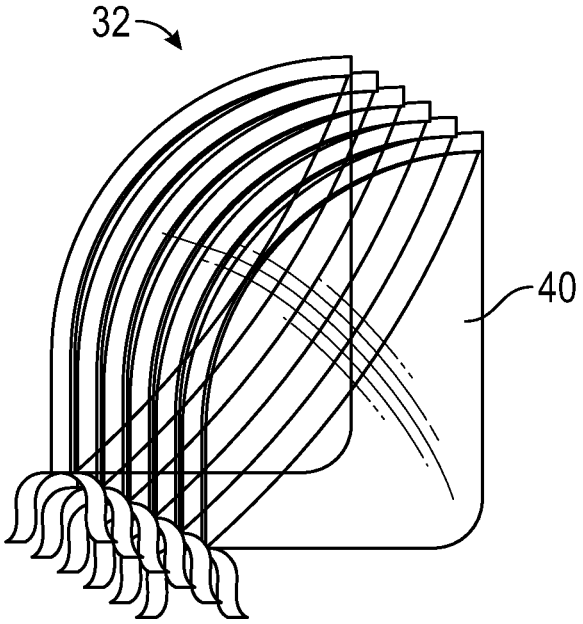
FIG. 17B is a perspective view of the embodiment in a fully collapsed position.

FIG. 16 is a perspective view of another embodiment of enclosure 20 in an erect position. Two pads 700 are provided for access to the enclosure interior. This embodiment may require manipulation of the flexible rods to transition between the collapsed and erect positions. FIGS. 17A & 17B are a perspective views of the enclosure in a partially collapsed and a fully collapsed position, respectively.

Figure 18:
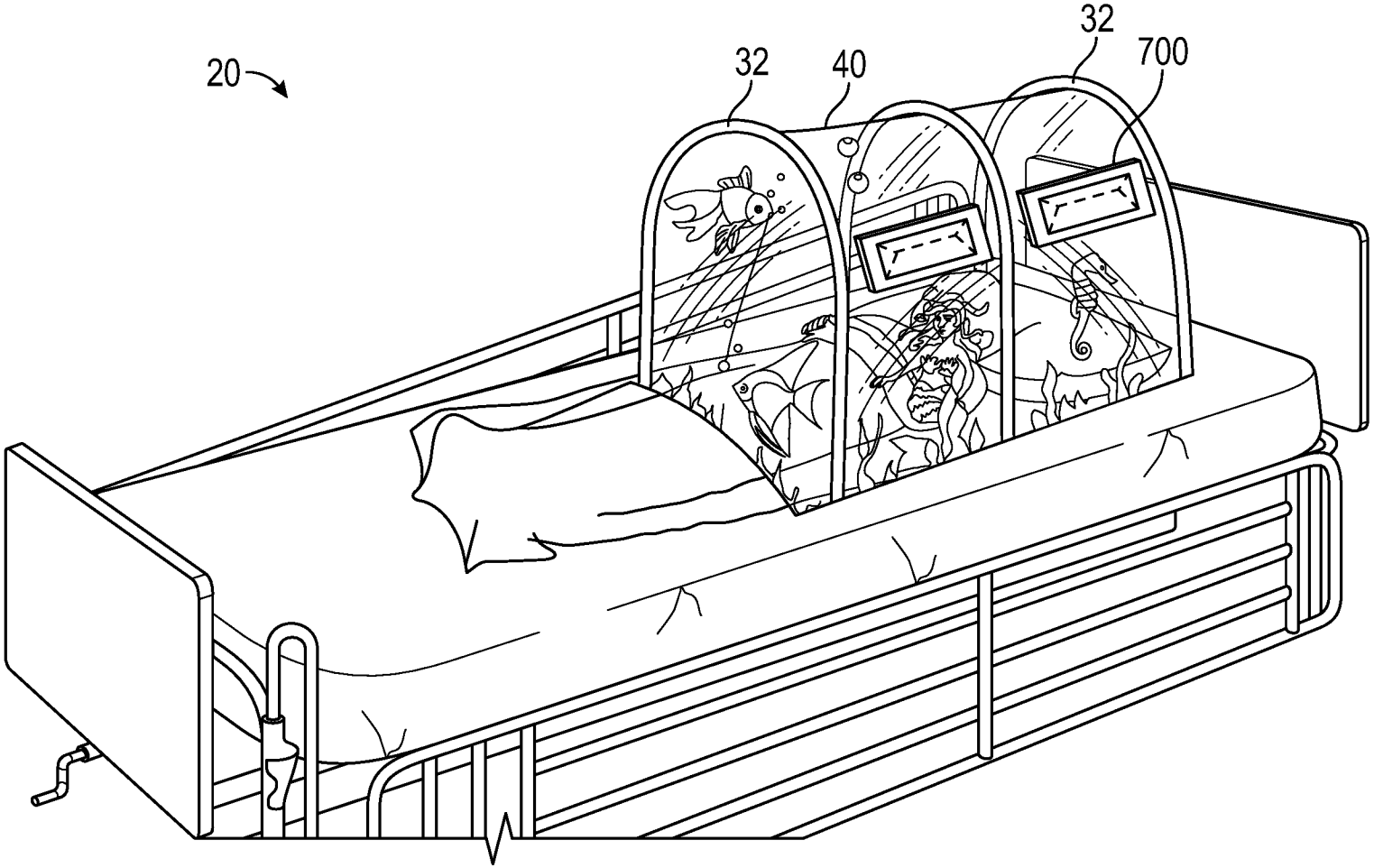
FIG. 18 is a perspective view of another embodiment of the enclosure.

FIG. 18 is a perspective view of another embodiment of the enclosure. In this embodiment, covering 40 includes patterns or designs for purposes of entertaining, distracting, or soothing the patient. For example, a covering 40 suitable for a children's enclosure may have an aquatic themed design. Other example designs include a castle, a fire truck, a spaceship, stuffed animals, fantasy animals, cartoon characters, a woodland scene, a farm scene, an ocean scene, or a sky scene.

Figure 19:
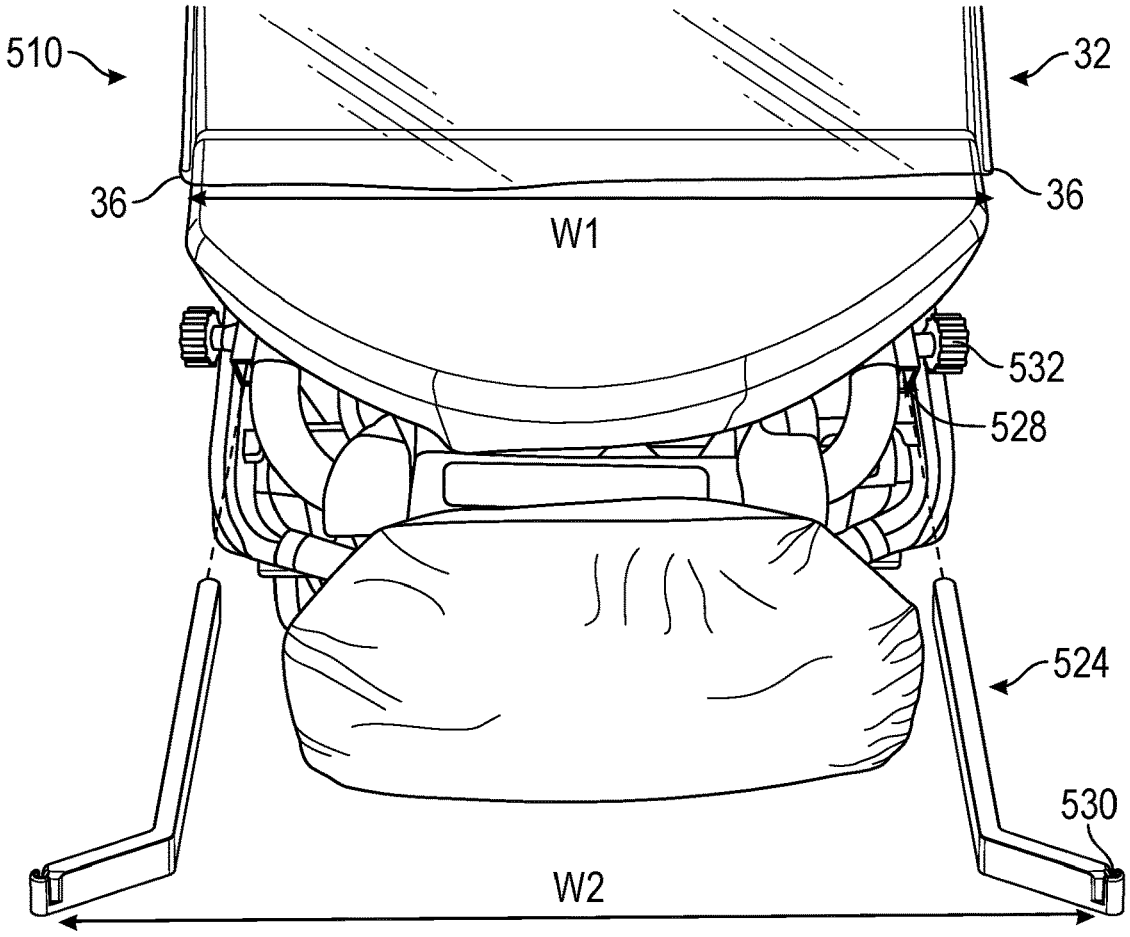
FIG. 19 is a partial enlarged top view of an embodiment of the enclosure cooperating with another embodiment of the coupler.
Figure 20:
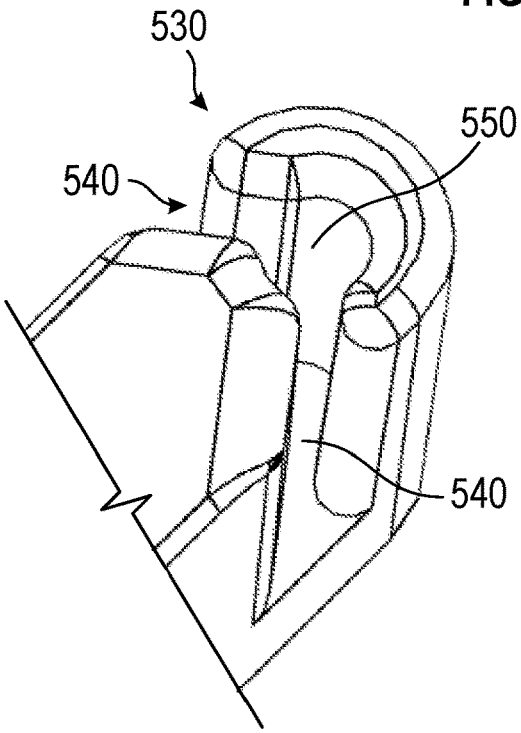
FIG. 20 is a partial enlarged perspective view of the coupler.

FIG. 19 shows another embodiment of adjustable arm 524 of the coupler. In this embodiment, arm 524 is connected to the patient support apparatus via clamp 522 as described above. FIG. 20 shows an enlarged view of recess 530 of the arm. Recess 530 has two wings 540 each extending from a bore 550. The angle between wings 540 may be between 60 degrees and 120 degrees. In the shown embodiment, the angle between wings 540 is about 90 degrees.

Connector 36 of flexible rod 32 is a free tip dimensioned for insertion into recess 530. Connector 36 may be shaped substantially complimentary to recess 530. Connector 36 may include arms shaped for insertion into wings 540. Such a configuration of connector 36 may support head end 42 and each side 48 with an angle therebetween substantially equal to the angle between the wings 540.

Figure 21:
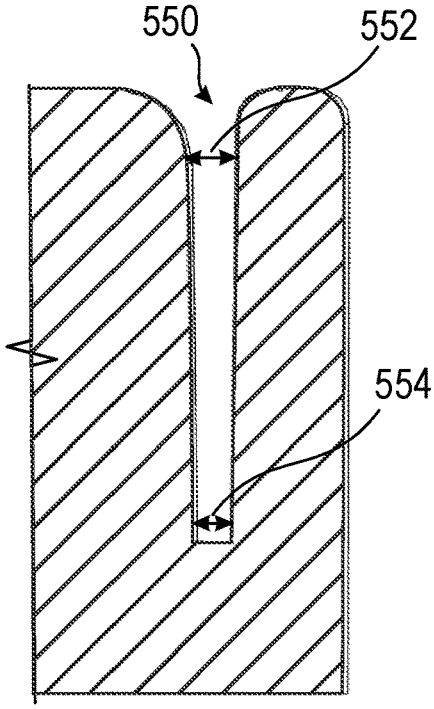
FIG. 21 is a partial enlarged cross-sectional view of the coupler.

FIG. 21 is an enlarged cross-section of recess 530 showing bore 550. In some embodiments, bore 550 narrows or is tapered from the bore top 552 to the bore bottom 554. The larger opening at bore top 552 facilitates initial insertion of connector 36 into bore 550. At the more narrow bore bottom 554 connector 36 is closely retained and resistance against removal of the connector from the bore is increased. This feature allows easy and rapid installation of the enclosure onto a patient support apparatus while also providing a stable attachment which resists decoupling when the enclosure is accessed via portals or when the support apparatus is being adjusted or transferred.

Referring again to FIG. 19, in some embodiments the width W1 between connectors 36 of head end 42 may be less than the width W2 between recesses 530 of the adjustable arms. This feature provides outward tension on flexible rod 32 when the enclosure is connected to the adjustable arms. This tension increases rigidity of the enclosure and adds stability, which is especially important when a patient is being transported outside or when the enclosure is being accessed by care personnel. In embodiments, adjustable arms 524 may bend slightly to simplify initial attachment, and the arms may resiliently return to their initial position of wider spacing.

Further provided are systems wherein enclosure 20 may be packaged with one or more of coupler 520, an air filtration system 600, or one or more pads 700.

In terms of use, a method of isolating an airspace 800 surrounding a patient 500 supported on a patient support apparatus 510 includes (refer to FIGS. 1-18):

a) providing an aerosol containment enclosure 20 including:

a flexible rod 32 supporting a transparent, substantially aerosol impermeable covering 40;

the enclosure being collapsible to a predetermined collapsed shape and self-erecting to a predetermined erect shape;

wherein in the erect shape the enclosure is semi-rigid and has a head end 42, a foot end 44, and two opposing sides 48, each of the foot end and the two opposing sides having a flexible portion (54, 58) configured to be draped over the patient support apparatus; and wherein the flexible rod has a connector 36 which is proximate the head end when the enclosure is in the erect shape, the connector structured for attachment to the patient support apparatus;

b) when the enclosure is in the collapsed shape, releasing the enclosure from the collapsed shape whereby the enclosure self-erects to the erect shape;

c) when the enclosure is in the erect shape, placing the enclosure above the patient support apparatus such that the head end is oriented toward a head of the patient, and the flexible portions of each of foot end and the two opposing sides are draped over the patient support apparatus; and d) attaching the connector of the flexible rod to the patient support apparatus; whereby the airspace surrounding the patient is substantially isolated within the enclosure.

The method further including the connector cooperating with a coupler by:

providing a coupler 520 having a recess 530;

in (a), the connector of the flexible rod being a free tip sized and dimensioned for insertion into the recess of the coupler;

connecting the coupler to a frame 512 of the patient support apparatus; and, in (d), connecting the free tip of the flexible rod to the patient support apparatus by inserting the free tip into the recess of the coupler.

The method further including adjusting the position of the coupler by:

the frame of the patient support apparatus having a length and a top 514;

wherein the coupler is adjustably positionable along the length of the frame; and after (d), adjusting the position of the coupler along the length of the frame whereby a distance between the head end of the enclosure and the top of the frame is varied.

The method further including transferring the patient by:

cooperating with a sheet located between the patient and the patient support apparatus, and with a second patient support apparatus;

after (d), detaching the connector of the flexible rod from the patient support apparatus;

on each of the two opposing sides, folding the flexible portion with the sheet to create a folded portion; and grasping the folded portions and lifting the patient, the sheet, and the enclosure off of the patient support apparatus and lowering the patient, the sheet, and the enclosure onto the second patient support apparatus;

whereby the airspace surrounding the patient remains substantially isolated within the enclosure as the patient is lifted and lowered onto the second patient support apparatus.

The embodiments of the aerosol containment enclosure and methods of use described herein are exemplary and numerous modifications, combinations, variations, and rearrangements can be readily envisioned to achieve an equivalent result, all of which are intended to be embraced within the scope of the appended claims. Further, nothing in the above-provided discussions of the aerosol containment enclosure and methods of use should be construed as limiting the invention to a particular embodiment or combination of embodiments. The scope of the invention is defined by the appended claims.

We claim:

1. An aerosol containment enclosure for cooperation with a patient support apparatus, the enclosure comprising:

a flexible rod supporting a transparent, substantially aerosol impermeable covering;

the flexible rod with the covering supported thereon being collapsible to a predetermined collapsed shape and expandable to a predetermined erect shape;

wherein in the erect shape the enclosure is semi-rigid and has a rigid portion extending continuously from a head end to a foot end, two opposing sides, each of the foot end and the two opposing sides having a flexible portion sized to be draped over the patient support apparatus, and an open bottom bounded by the flexible portion of each of the foot end and the two opposing sides;

the covering having a portal in one of the two opposing sides, the portal including an aperture and a flap completely covering the aperture, the flap sealed around a portion of the aperture and having an unsealed portion that overlaps the covering, the portal sized to provide access to an interior of the enclosure along an entire length of the interior defined by the rigid portion, the access provided between the covering and the unsealed portion of the flap by lifting and outwardly extending the flap, the flap configured to restrict transfer of aerosols out of the interior when outwardly extended; and wherein the flexible rod has a connector which is proximate the head end when the enclosure is in the erect shape, the connector structured for attachment to the patient support apparatus; and wherein the portal is bounded at the head end and the foot end by the flexible rod.

2. The enclosure according to claim 1, further cooperating with a coupler having a recess, the coupler connected to the patient support apparatus, wherein:

the connector of the flexible rod is a free tip sized and dimensioned for insertion into the recess of the coupler.

3. The enclosure according to claim 1, wherein:

the enclosure is self-erecting to the predetermined erect shape.

4. The enclosure according to claim 1, wherein:

in the erect shape, the flexible portion of each of the two opposing sides extends below the flexible rod.

5. The enclosure according to claim 1, wherein:

in the erect shape, the flexible portion of the foot end extends beyond the flexible rod away from the head end.

6. The enclosure according to claim 1, wherein:

the covering is formed of a material having a thickness of between about 0.002 inches and about 0.008 inches.

7. The enclosure according to claim 1, for use by a care provider having hands and arms, wherein:

the portal is sized to provide access into the enclosure for both of the hands of the care provider with the flap extending outwardly above both of the arms of the care provider.

8. An aerosol containment enclosure system for cooperation with a patient support apparatus having a frame, the frame having a length spanning a major dimension of the frame and a top at one end of the length, the system comprising:

an enclosure including a flexible rod supporting a transparent, substantially aerosol impermeable covering;

the enclosure being collapsible to a predetermined collapsed shape and self-erecting to a predetermined erect shape;

a coupler having an extensible arm terminating in a recess, the coupler configured for connection to the frame of the patient support apparatus with the extensible arm oriented for translational positioning, wherein the translational positioning of the extensible arm varies a location of the recess relative to the top of the frame;

wherein in the erect shape the enclosure is semi-rigid and has a head end, a foot end, and two opposing sides, each of the foot end and the two opposing sides having a flexible portion configured to be draped over the patient support apparatus; and wherein the flexible rod has a free tip which is proximate the head end when the enclosure is in the erect shape, the free tip sized and dimensioned for insertion into the recess of the coupler.

9. The system according to claim 8, wherein:

the recess of the coupler has a bore and two wings defining the bore and directly extending therefrom; and, the free tip of the flexible rod is shaped complementary to the recess.

10. The system according to claim 9, wherein:

a width of the bore is tapered to narrow from a bore top to a bore bottom.

11. The system according to claim 8, further including:

a portal in the covering that provides access to an interior of the enclosure and that restricts transfer of aerosols out of the interior.

12. The system according to claim 8, wherein:

in the erect shape, the flexible portion of each of the two opposing sides extends below the flexible rod.

13. The system according to claim 8, wherein:

in the erect shape, the flexible portion of the foot end extends beyond the flexible rod away from the head end.

14. The system according to claim 8, further including:

an air filtration system through which air is transferred to or from an interior of the enclosure.

15. The system according to claim 8, wherein:

the covering is formed of a material having a thickness of between about 0.002 inches and about 0.008 inches.

16. The system according to claim 8, further including:

a pad having a sealing surface configured to be connected to an exterior surface of the enclosure, the sealing surface surrounding a frangible layer.

17. A method of isolating an airspace surrounding a patient supported on a patient support apparatus having a frame, the frame having a length spanning a major dimension of the frame and a top at one end of the length, the method comprising:

a) providing an aerosol containment enclosure system including:

an enclosure including a flexible rod supporting a transparent, substantially aerosol impermeable covering;

the enclosure being collapsible to a predetermined collapsed shape and self-erecting to a predetermined erect shape;

a coupler having an extensible arm terminating in a recess, the coupler configured for connection to the frame of the patient support apparatus with the extensible arm oriented for translational positioning, wherein the translational positioning of the extensible arm varies a location of the recess relative to the top of the frame;

wherein in the erect shape the enclosure is semi-rigid and has a head end, a foot end, and two opposing sides, each of the foot end and the two opposing sides having a flexible portion configured to be draped over the patient support apparatus; and wherein the flexible rod has a free tip which is proximate the head end when the enclosure is in the erect shape, the free tip sized and dimensioned for insertion into the recess of the coupler;

b) when the enclosure is in the collapsed shape, releasing the enclosure from the collapsed shape whereby the enclosure self-erects to the erect shape;

c) when the enclosure is in the erect shape, placing the enclosure above the patient support apparatus such that the head end is oriented toward a head of the patient, and the flexible portions of each of foot end and the two opposing sides are draped over the patient support apparatus; and d) attaching the coupler to the patient support apparatus and inserting the free tip into the recess of the coupler;

whereby the airspace surrounding the patient is substantially isolated within the enclosure.

18. The method of claim 17, further including:

wherein the coupler is adjustably positionable by translation along the length of the frame; and after (d), adjusting the position of the coupler along the length of the frame whereby a distance between the head end of the enclosure and the top of the frame is varied.

19. The method of claim 17, further cooperating with a sheet located between the patient and the patient support apparatus, and with a second patient support apparatus, the method further including:

after (d), detaching the free tip of the flexible rod from the recess of the coupler;

on each of the two opposing sides, folding the flexible portion with the sheet to create a folded portion; and grasping the folded portions and lifting the patient, the sheet, and the enclosure off of the patient support apparatus and lowering the patient, the sheet, and the enclosure onto the second patient support apparatus;

whereby the airspace surrounding the patient remains substantially isolated within the enclosure as the patient is lifted and lowered onto the second patient support apparatus.

* * * * *